US009073379B2

(12) United States Patent
Grassia

(10) Patent No.: US 9,073,379 B2
(45) Date of Patent: Jul. 7, 2015

(54) TABBED FILE FOLDER WITH CORNER RETENTION ELEMENTS

(75) Inventor: Lauren Grassia, East Northport, NY (US)

(73) Assignee: R.R. DONNELLEY & SONS COMPANY, Chicago, IL (US)

( * ) Notice: Subject to any disclaimer, the term of this patent is extended or adjusted under 35 U.S.C. 154(b) by 73 days.

(21) Appl. No.: 12/538,103

(22) Filed: Aug. 7, 2009

(65) Prior Publication Data

US 2010/0032473 A1 Feb. 11, 2010

Related U.S. Application Data

(60) Provisional application No. 61/087,514, filed on Aug. 8, 2008.

(51) Int. Cl.

| | |
|---|---|
| ***B65D 27/00*** | (2006.01) |
| ***B65D 37/00*** | (2006.01) |
| ***B42F 21/02*** | (2006.01) |
| ***B42F 7/02*** | (2006.01) |

(52) U.S. Cl.
CPC .. *B42F 21/02* (2013.01); *B42F 7/02* (2013.01)

(58) Field of Classification Search
CPC ..... B42F 7/06; B42F 7/04
USPC ..... 229/67.2, 67.3, 67.4
See application file for complete search history.

(56) References Cited

U.S. PATENT DOCUMENTS

| | | | | |
|---|---|---|---|---|
| 565,818 A | | 8/1896 | Ward | |
| 825,174 A | | 7/1906 | Appleton | |
| 1,221,884 A | * | 4/1917 | Martin | 229/67.1 |
| 1,457,638 A | * | 6/1923 | Skelton | 229/67.1 |
| 1,914,001 A | | 6/1933 | Warshay | |
| 2,989,023 A | | 6/1961 | Ellingsen | |

(Continued)

FOREIGN PATENT DOCUMENTS

| | | |
|---|---|---|
| CN | 2188034 Y | 1/1995 |
| CN | 1683168 A | 10/2005 |

(Continued)

OTHER PUBLICATIONS

International Search Report and Written Opinion dated Mar. 16, 2010 for International Application No. PCT/US2009/053231.

(Continued)

*Primary Examiner* — Jes F Pascua
*Assistant Examiner* — Derek Battisti
(74) *Attorney, Agent, or Firm* — Hanley, Flight & Zimmerman, LLC

(57) ABSTRACT

Exemplary embodiments according to the present invention relate to a file comprising a cover member with front and back cover panels that are hinged to each other for movement between open and closed positions, wherein the cover panels in the closed position define an interior space configured and dimensioned for containing a plurality of stacked papers. The cover panels may have first and second corners disposed opposite from the hinge. At least one of the cover panels may comprise a tab portion extending away from the hinge and disposed between the corners. First and second elastic retention elements may each be secured to one of the cover panels. The first and second retention elements may be disposed and configured for looping around the first and second corners of the other cover panel, respectively, in the closed position for retaining the closed position.

28 Claims, 6 Drawing Sheets

(56) References Cited

U.S. PATENT DOCUMENTS

| | | | | | |
|---|---|---|---|---|---|
| 3,605,287 | A | * | 9/1971 | Jonesi | 434/85 |
| 4,778,201 | A | | 10/1988 | Kouno et al. | |
| 4,940,068 | A | | 7/1990 | Pokorny et al. | |
| 4,958,728 | A | | 9/1990 | Effendi | |
| D323,348 | S | | 1/1992 | Tooker | |
| 5,741,028 | A | * | 4/1998 | Hatano et al. | 281/45 |
| 5,871,142 | A | | 2/1999 | Josephson | |
| 5,996,881 | A | * | 12/1999 | Smith | 229/67.1 |
| 6,354,486 | B1 | | 3/2002 | Ho | |
| 6,394,497 | B1 | | 5/2002 | Ho | |
| 6,439,611 | B1 | | 8/2002 | Chen | |
| 6,453,589 | B1 | * | 9/2002 | Schwartz | 40/359 |
| 6,659,336 | B2 | * | 12/2003 | Brennan | 229/67.1 |
| 6,739,784 | B1 | | 5/2004 | Tims et al. | |
| D499,761 | S | | 12/2004 | Walley et al. | |
| D521,072 | S | | 5/2006 | Hough et al. | |
| D529,963 | S | | 10/2006 | Hough et al. | |
| 7,252,452 | B2 | | 8/2007 | Africa et al. | |
| D577,766 | S | * | 9/2008 | Rydzewski | D19/26 |
| 2003/0183679 | A1 | * | 10/2003 | Ong | 229/67.3 |
| 2004/0253045 | A1 | | 12/2004 | Walley et al. | |
| 2006/0138765 | A1 | | 6/2006 | Girard | |
| 2006/0266807 | A1 | * | 11/2006 | Shook | 229/67.3 |
| 2007/0297848 | A1 | * | 12/2007 | Girard | 402/60 |

FOREIGN PATENT DOCUMENTS

| | | | | |
|---|---|---|---|---|
| CN | 2858292 | Y | 1/2007 | |
| FR | 2754763 | * | 10/1996 | B42F 7/04 |
| JP | 60-083775 | | 6/1985 | |
| JP | 09-295488 | | 11/1997 | |
| JP | 03-105385 | | 9/2004 | |
| KR | 20-1987-0005104 | | 4/1987 | |
| KR | 10-0690942 | | 3/2007 | |

OTHER PUBLICATIONS

First Chinese Office Action for Chinese Patent Application No. 200980130937.8 mailed on Feb. 18, 2013.

Archived Wikipedia Article ("File Folder") Sep. 26, 2007, [online], [retrieved on Mar. 30, 2012] Retrieved from Archive.org using Internet <URL: http://web.archive.org/web/200709261.

The State Intellectual Property Office of the People'S Republic of China, "Notification for Patent Registration Formalities and Notification on Grant of Patent Right for Invention," issued in connection with Chinese Patent Application No. 200980130937.8, issued on Jan. 16, 2015, 4 pages.

The State Intellectual Property Office of the People'S Republic of China, "The Correct Version of Notification on Grant of Patent Right for Invention," issued in connection with Chinese Patent Application No. 200980130937.8, issued on Feb. 4, 2015, 4 pages.

* cited by examiner

TABBED FILE FOLDER WITH CORNER RETENTION ELEMENTS

CROSS REFERENCE TO RELATED APPLICATION

The present application claims priority from U.S. Provisional Patent Application No. 61/087,514 filed Aug. 8, 2008, the disclosure of which is incorporated herein by reference in its entirety.

FIELD OF THE INVENTION

The present invention relates to a tabbed file with retention elements that loop around corners of the file.

BACKGROUND INFORMATION

File folders commonly have been used to organize papers and groups of papers. Simple forms of file folders typically have a front and back covers, often made of a single piece of semi-rigid paper or plastic that is bent so that the front cover folds up against the back cover. Tabs are provided in varying locations on folders within a same filing system so that the positions of the tabs alternate to permit various tabs to be viewed at once when the folders are placed one in front of the other.

Some known mechanism to keep papers from falling out of the closed file include, e.g. pockets and flaps. Pockets are generally made from additional material that is commonly attached to the interior of the file. One or more flaps are sometimes provided extending from edges of a cover and are capable of being folded over the cover so as to form a variant of a pocket or pouch. The front cover and back cover may then be folded towards one another and held together with, e.g., a string or elastic band. U.S. Pat. No. 6,453,589, for example "provides for an open file folder comprising a clear paneled portion front cover, with a hinged folding axis, a flap retaining tab and slot, and a retaining panel for locking the folding portion of the front panel.".

Other mechanisms, such as clips, also have been used to secure papers in a file folder, as used, for instance, in U.S. Pat. No. 6,439,611. The file folder panel of this patent has a flap on the panel top border that provides pre-perforated holes and groove as a passage for the file clips to hold the paper documents.

There is a need for a file folder with a simple method of retaining a file closed and preferably also retaining papers therein.

SUMMARY OF EXEMPLARY EMBODIMENTS

According to one exemplary embodiment of the present invention, a file is provided comprising a cover member with front and back cover panels that are hinged to each other at a hinge for movement between open and closed positions. The cover panels in the closed position can define an interior space therebetween configured and dimensioned for containing a plurality of stacked papers. The cover panels can have first and second corners disposed opposite from the hinge. At least one of the cover panels can comprise a tab portion extending away from the hinge and disposed between the corners.

First and second elastic retention elements can each be secured to one of the cover panels. The first and second retention elements can be disposed and configured for looping around the first and second corners of the other cover panel, respectively, in the closed position for retaining the closed position.

The tab can be disposed between one of the retention elements and its adjacent corner with the retention elements looped around the corners. Additionally, the tab can be disposed between the retention elements with the retention elements looped around the corners. The retention elements can be secured to the same one of the cover panels and/or can be parts of a single elastic bungee.

The retention elements can be secured to the cover panel for naturally extending across from one cover panel to the other at first and second locations, and the tab can be disposed spaced from said locations.

The retention elements can be secured to the cover panel to cross from one panel to the other within about a central third of a height of the front and back panels measured from the hinge to an edge of each panel opposite from the hinge. Accordingly, the retention elements can be positioned to retain contents of the folder laterally in the interior space when the retention elements are looped over the corners with the folder in the closed position. Additionally, the retention elements can be secured to the cover panel to cross from one panel to the other at an edge of the cover panels opposite from the hinge within about a central third of said edge to retain contents of the folder in the interior space when the retention elements are looped over the corners with the folder in the closed position.

The file can be a file folder dimensioned for holding letter-size paper or larger, including legal-size paper. Alternatively, the file can be a file folder dimensioned for holding paper of letter or A4 size or larger. The file can be a bi-fold file folder, for example.

The file may be configured for holding a stack of paper with a thickness of at least about ½ inch. The cover panels can be sized so as to completely cover the front and back of the plurality of paper in the closed position.

According to another exemplary embodiment of the present invention, a filing system is provided that comprises a group of files as described above. The tab of a first of the files can be disposed between the first retention element and the first corner with the retention elements looped around the corners. The tab of a second of the files can be disposed between the second retention element and the second corner with the retention elements looped around the corners. The tab of a third of the files can be disposed between the retention elements with the retention elements looped around the corners. Accordingly, when the files are aligned one in front of the other, each of said tabs may be visible.

In another embodiment, one of the retention elements loops around the corner and the tab, which may be positioned on an edge opposite or adjacent to the hinge.

The present invention provides an improved mechanism for closure and/or retention of papers filed therein.

BRIEF DESCRIPTION OF THE DRAWINGS

Further features and advantages of the invention will become apparent from the following detailed description taken in conjunction with the accompanying figures showing illustrative embodiments of the invention, in which.

Figure 1:
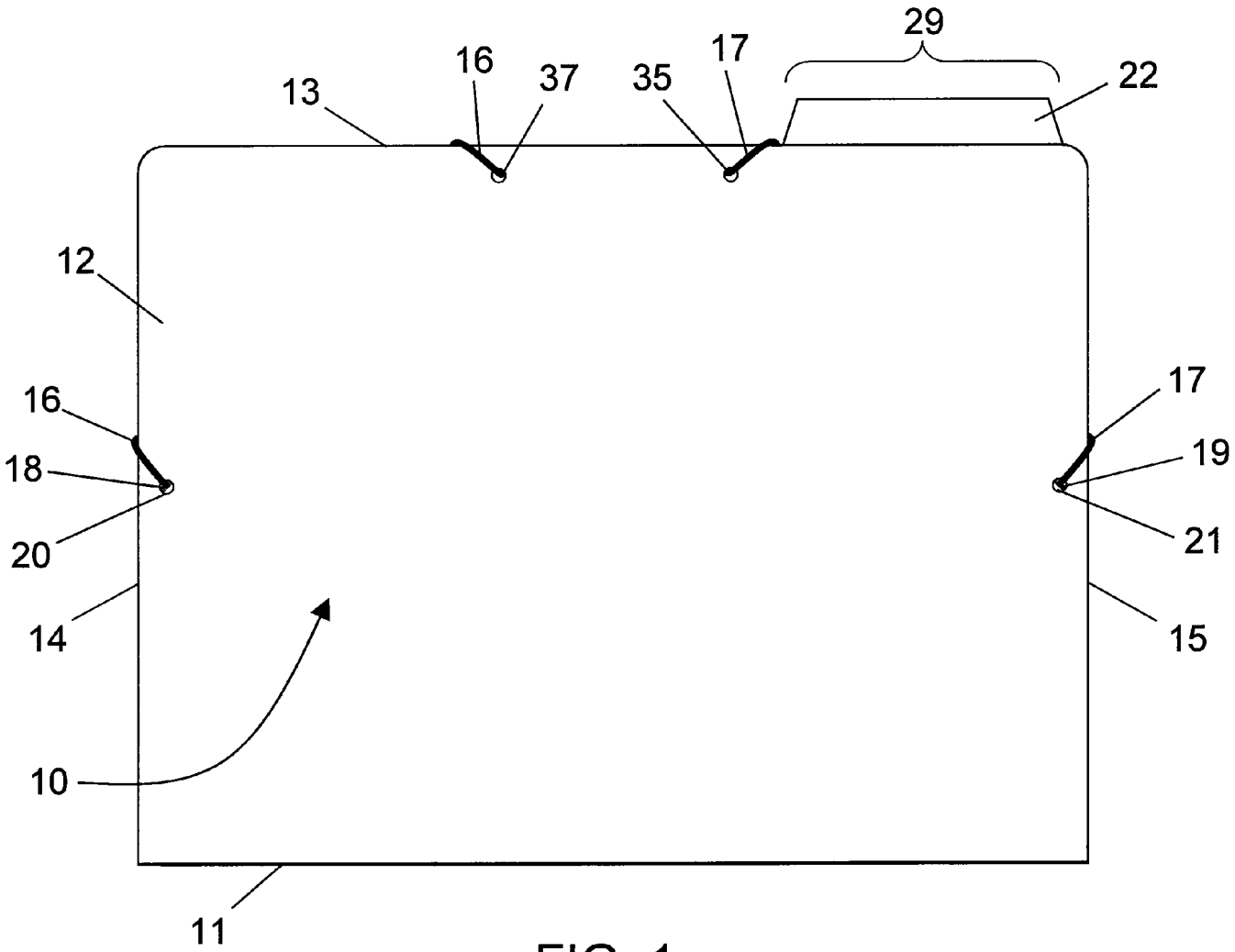
FIG. 1 is a front view of an exemplary embodiment of a file according to the present invention in a closed position.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described exemplary embodiments without departing from the true scope and spirit of the subject invention as defined by the appended claims.

DETAILED DESCRIPTION OF EXEMPLARY EMBODIMENTS

FIG. 1 is a front view of an exemplary embodiment of a file 10 according to the present invention in a closed position. As shown in this figure, file 10 can include a hinge 11 that extends along the bottom of front cover panel 12. The exemplary embodiment of front cover panel 12 illustrated is predominantly rectangular in shape when viewed from the front or back, with edges 14 and 15 being roughly perpendicular to hinge 11, although alternative shapes can be used.

According to the exemplary embodiment illustrated in FIG. 1, elastic retention elements 16 and 17 are secured or mounted to front cover panel 12 via anchors or terminals 18 and 19 or by another attachment mechanism. For example, terminals 18 and 19 can be a of a "T" type of configuration with the stem of such configuration being fastened to an end of, e.g., an elastic band or bungee including elastic retention elements 16 and 17. Alternatively, terminals 18 and 19 can of any other type of shaped terminus, such as, e.g., disc, oval, square, triangle, that prevents the band or bungee of which elastic retention elements 16 and 17 are a part from becoming unsecured to front cover panel 12. In an alternative embodiment, the retention elements are secured to the rear cover, or one can be secured to the front cover and the other to the rear cover.

As shown in FIG. 1, terminals 18 and 19 can be secured onto the ends of a bungee that includes elastic retention elements 16 and 17. From its connection to terminal 18, elastic retention element 16 is shown as extending through hole 20 disposed on front cover panel 12 near side edge 14. Elastic retention element 16 then extends diagonally on the outside of the front cover panel 12 around lateral edge 14, diagonally over the outside of the back cover panel 26, then around top edge 13, and diagonally back over the outside of the front cover panel 12. Elastic retention element 16 then traverses through a hole 37 in front cover panel 12 near top edge 13, and the bungee extends horizontally across the inside of the front cover panel 12 and returns back through another hole 35 in front cover panel 12 near top edge 13 to provide the other retention element 17. Elastic retention element 17 then extends diagonally over the outside of the front cover panel 12 and over top edge 13 and then reappears in FIG. 1 upon extending diagonally over the back cover panel 26 and around side edge 17. Finally, elastic retention element 17 extends diagonally over the back cover panel 26 and traverses through hole 21 in front cover panel 12, where it is secured to terminal 19, for example.

Figure 2:
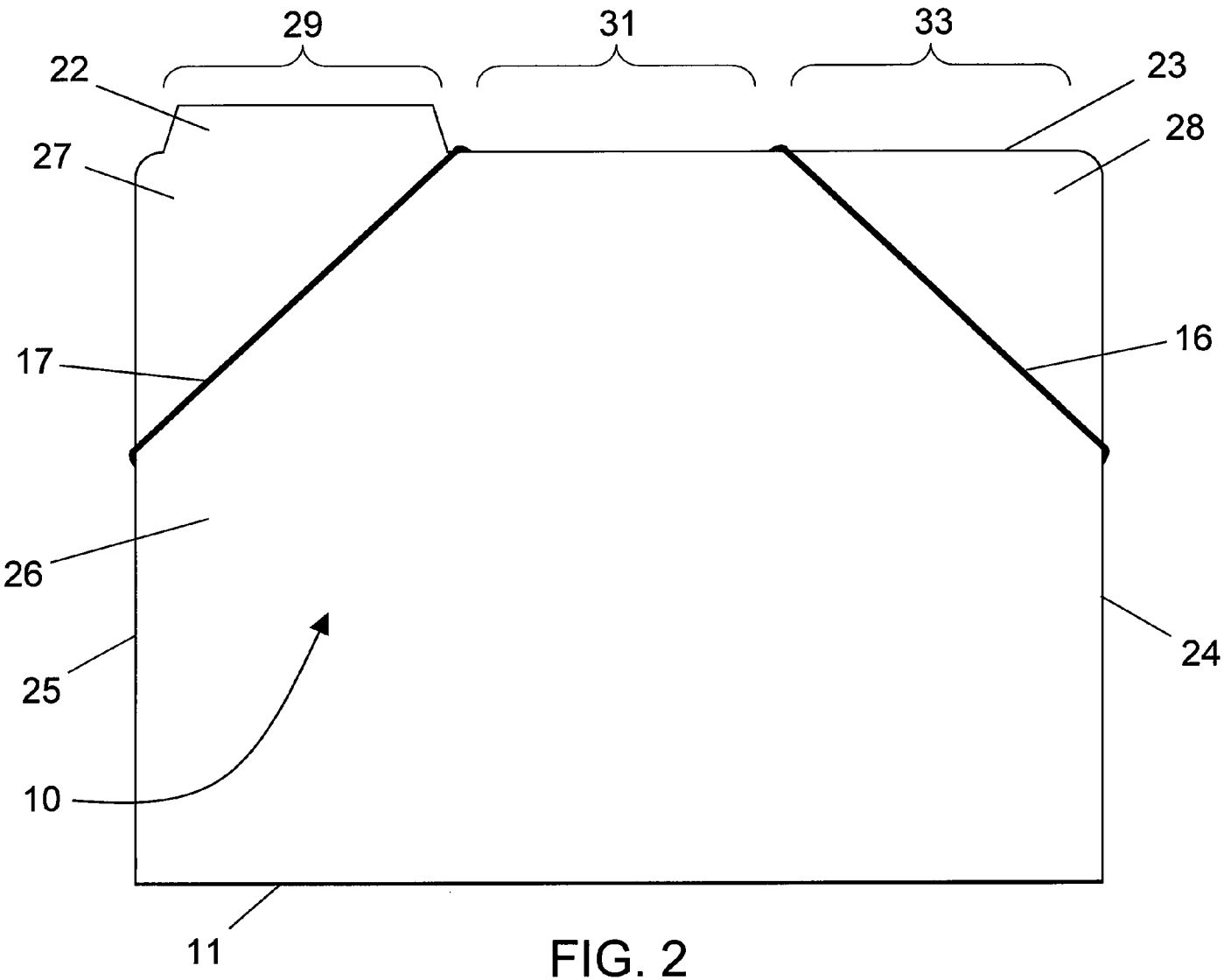
FIG. 2 is a rear view thereof.

FIG. 2 is a rear view of an exemplary embodiment of a file according to the present invention in a closed position. As shown in FIG. 2, hinge 11 hinge 11 extends along the bottom of back cover panel 26. Back cover panel 26 is illustrated as being predominantly rectangular in shape so as to largely correspond in shape with front cover panel 12. However, it should be clear to one skilled in the art that files with shapes other than rectangular can be used, although the preferred embodiments have two corners opposite from the hinge on which to loop the retention elements. Moreover, one skilled in the art should ascertain that it is not necessary for back cover panel 26 to be similarly shaped as front cover panel 12 but that back panel 26 can vary in shape from front panel 26 in various embodiments of the present invention. In embodiments with differently shaped back and front covers, it is often preferred that the portions of the cover edges that support the retention elements when they are looped over the cover corners are substantially overlapping or close to each other when the file is closed, although other configurations can be employed depending on the position of the retention elements.

As illustrated in FIG. 2, back panel 26 can include edges 24,25 that extend away from the hinge line 11 and which are preferably perpendicular or roughly perpendicular to hinge 11, and tope edge 23, which is parallel or roughly parallel to hinge 11. Corner 27 is disposed on back cover panel 26 in proximity to where top edge 23 meets edge 25, shown in FIG. 2. Similarly, corner 28 is disposed in proximity to where top edge 23 meets edge 24.

Top edge 23 can also include tab area 29, which extends away from hinge 11 as shown in FIG. 2. Disposed in tab area 29 can be one or more tabs. The exemplary embodiment illustrated in FIG. 2 shows that one tab 22 can be disposed in tab area 29 and occupy the large majority if not all tab area 29. Alternatively, tab area 29 can be configured so that two, three, four or more tabs 22 can be disposed in tab area 29 when multiple files are positioned together. A plurality of tabs 22 disposed in tab area 29 can also extend from back cover panel 26 and be bendable, perforated or otherwise configured for adaptation to a user's needs.

Further, although tab area 29 is shown as occupying a little less than ⅓ of the length of top edge 23, one skilled in the art of files should ascertain that tab area 29 can be larger or smaller. For example, tab area 29 can be configured to occupy a little less than ½ of the total length of top edge 23 so that there can be two tab areas disposed along top edge 23. Tab area 29 can also be configured to occupy a little less than ⅕ of the length of top edge 23 and so five tab areas can be disposed along top edge 23. It is also possible for tab area 29 to be configured to occupy a little less than ⅐ the length of top edge 23 so as to provide for seven tab areas, or to be configured to occupy a little less than 1/10 the length of top edge 23 so as to provide for ten tabs, or a little less than 1/31 the length of top edge 23 so as to provide for thirty tab areas, for example. The tab areas are preferably defined to exclude the area of the top and side edges on which the retention elements 16,17 will lie when looped over the corners, and are adjacent thereto. Thus, in the embodiment shown, there is one tab area 29,33 on the top edge 23 between each retention element 16,17 and corner 27,28, respectively, and a third, central tab area 31 between the retention elements 16,17.

Additionally, according to some exemplary embodiments, the tab areas and tab(s) can be positioned on either or both cover panels 12,26. The tab(s) may also extend from lateral edges 14,15,24,25 according to various exemplary embodiments of the present invention.

The size and shape of each tab, such as tab 29, for example, may vary based on a number of factors including, e.g., the size of the file and respective covers, the respective position of each tab, the number of tab areas and/or the number of tabs. Tab 29 as illustrated in FIG. 2 may be, e.g. roughly trapezoidal in shape having a base width of 2 inches, top width of 1¾ inches and a height of ⅓ inch. Such sized tab may preferably be used with a file 10 dimensioned for use with letter size paper (i.e. 8.5 in.×11 in.) and configured with three tab areas 29,31,33 along top edge 23 with each tab area having one tab, for example. It should be ascertained that such a configuration may provide the preferable amount of space between tabs for retaining elements 16,17 to extend over edge 23 without interfering with the tabs, for example. However, in certain embodiments of the present invention, the size of the tabs may be as small as ¼ inch (e.g., when 31 total tabs are desired) or as large as 5.3 inches (when only two tabs are desired), for example. It may also be preferable to have even larger tabs for certain embodiments, especially for, e.g. when a file is configured to hold sheets of paper larger than letter size, such as, e.g., legal size (i.e. 8.5 in.×14 in.) or A4 size (i.e. 8.27 in.× 11.69 in.), for example.

As shown in FIG. 2, elastic retention elements 16,17 can traverse back cover panel 26 so as to loop around the corners 27,28. With reference back to FIG. 1 and the corresponding description of the illustrated exemplary embodiment above, elastic retention element 16 can extend from front cover panel 12 around edge 14. When file 10 is in a closed position, as is shown FIGS. 1 and 2, edge 14 of front cover panel 12 corresponds to edge 24 of back cover panel 26. Therefore, elastic retention element 16 can extend from front cover panel 12 around edge 14 and around edge 24 to back panel cover 26, as illustrated in FIG. 2. Elastic retention element can then extend from edge 24 to top edge 23 to effectively loop corner 28 before extending over top edge 23, which can correspond with top edge 13 of front cover panel 12 when file 10 is in a closed position. FIG. 2 also shows that elastic retention element 17 can loop around corner 27 in a similar manner that elastic retention element 16 can loop around corner 28.

As one skilled in the art will ascertain, a configuration such as the one illustrated in FIGS. 1 and 2 will provide for containing papers placed in the interior space defined by cover panels 12,26 when file 10 is in a closed position. Such papers will be contained by hinge 11 on the bottom, elastic retention element 16 on one side (i.e. corresponding to edges 15,25), elastic retention element 17 on the opposite side (i.e. corresponding to edges 14,24), and by both elastic retention elements 16,17 on the top (i.e. corresponding to top edges 13,23).

Figure 3:
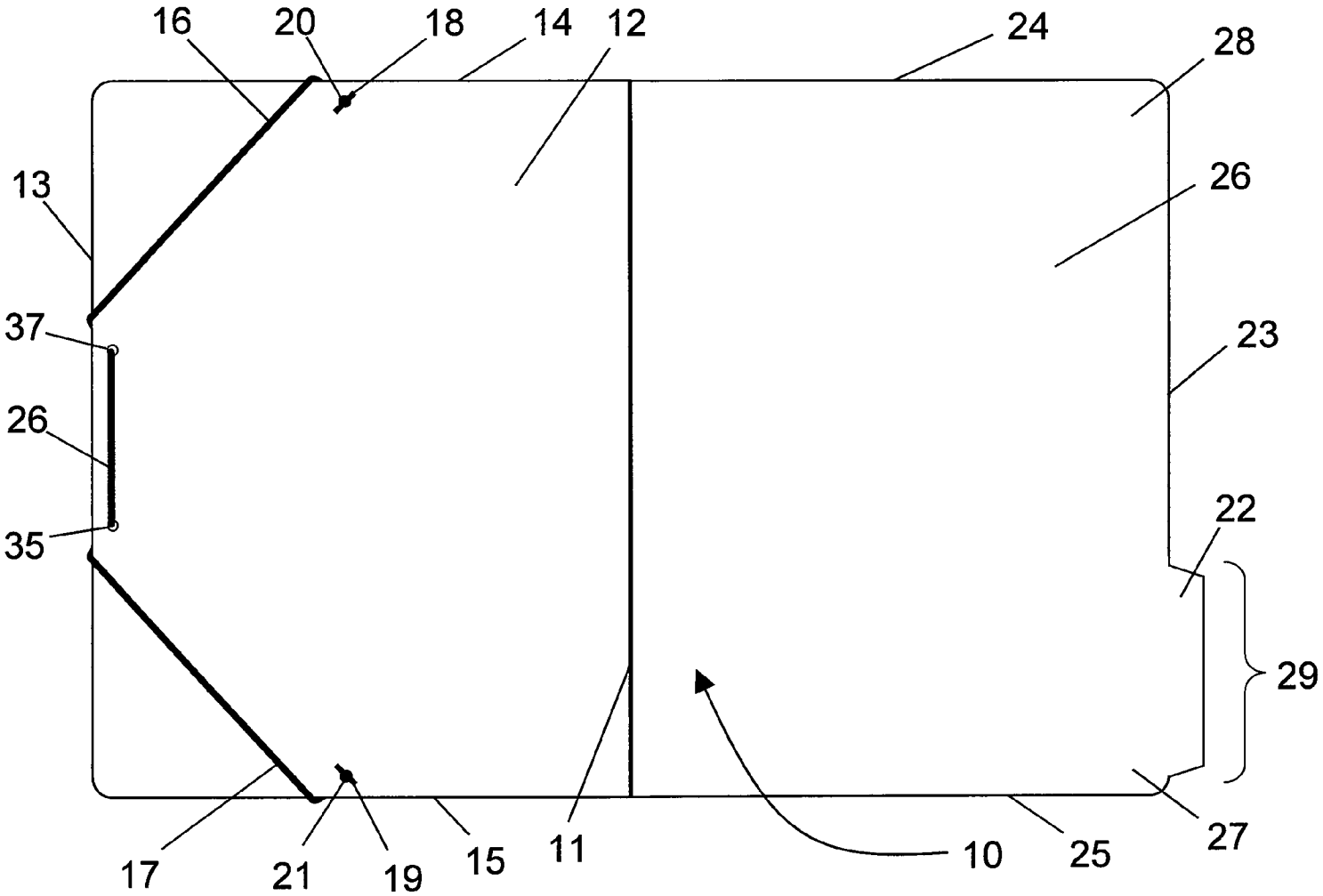
FIG. 3 is an interior view thereof in an open position.

FIG. 3 shows an exemplary embodiment of a file according to the present invention in an open position, with a view of the inside of cover panels 12,26. As can be seen in FIG. 3, the cross portion of terminals 18,19 are of a length greater than the diameter of holes 20,21, respectively. Thus, since the elastic portions of retention elements 16,17 are fastened near the center of terminals 18,19, respectively, the cross portions of terminals 18, 19 are unable to pass through holes 20,21, thereby securing retention elements 16,17 to front cover panel 12.

As mentioned above, terminals 16,17 can be of any shape or configuration so long as such shape or dimension prevents passage of terminals 16,17 through holes 20,21, respectively, when secured to the ends of the bungee or elastic band of the retention elements 16,17. Alternatively, the ends of the bungee or elastic band of the retention elements 16,7 are apart can also be secured or mounted directly to the inside of front cover panel 12 before extending through holes 20,21, respectively. Such ends can also be secured or mounted on the outside of front cover panel 12 as well, dispensing with the need for holes 20, 21 altogether, for example. In embodiments that use holes, such as the one illustrated in FIG. 3, for example, the location of holes 20,21 can vary both with respect to edges 14,15 as well as to edge 13. Similarly, the holes shown as being disposed near top edge 13 can also vary in their position.

Elastic element portion 26 is shown as being disposed near top edge 13 on the inside of front cover 12. This configuration is a result of a single bungee or elastic band being used, with elastic retention elements 16,17 being apart thereof. One skilled in the art will ascertain that two separate bungees or elastic bands can alternatively be used, corresponding to elastic retention elements 16,17, respectively. In such exemplary configuration, terminals can be disposed at each of the holes along top edge 13 in lieu of elastic band portion 26. Indeed, retention elements 16,17 could also be mounted on the outside of front cover panel 12 eliminating the need for the holes along top edge 13 altogether, in a similar to how holes 20,21 can be disposed with as described above.

Figure 4:
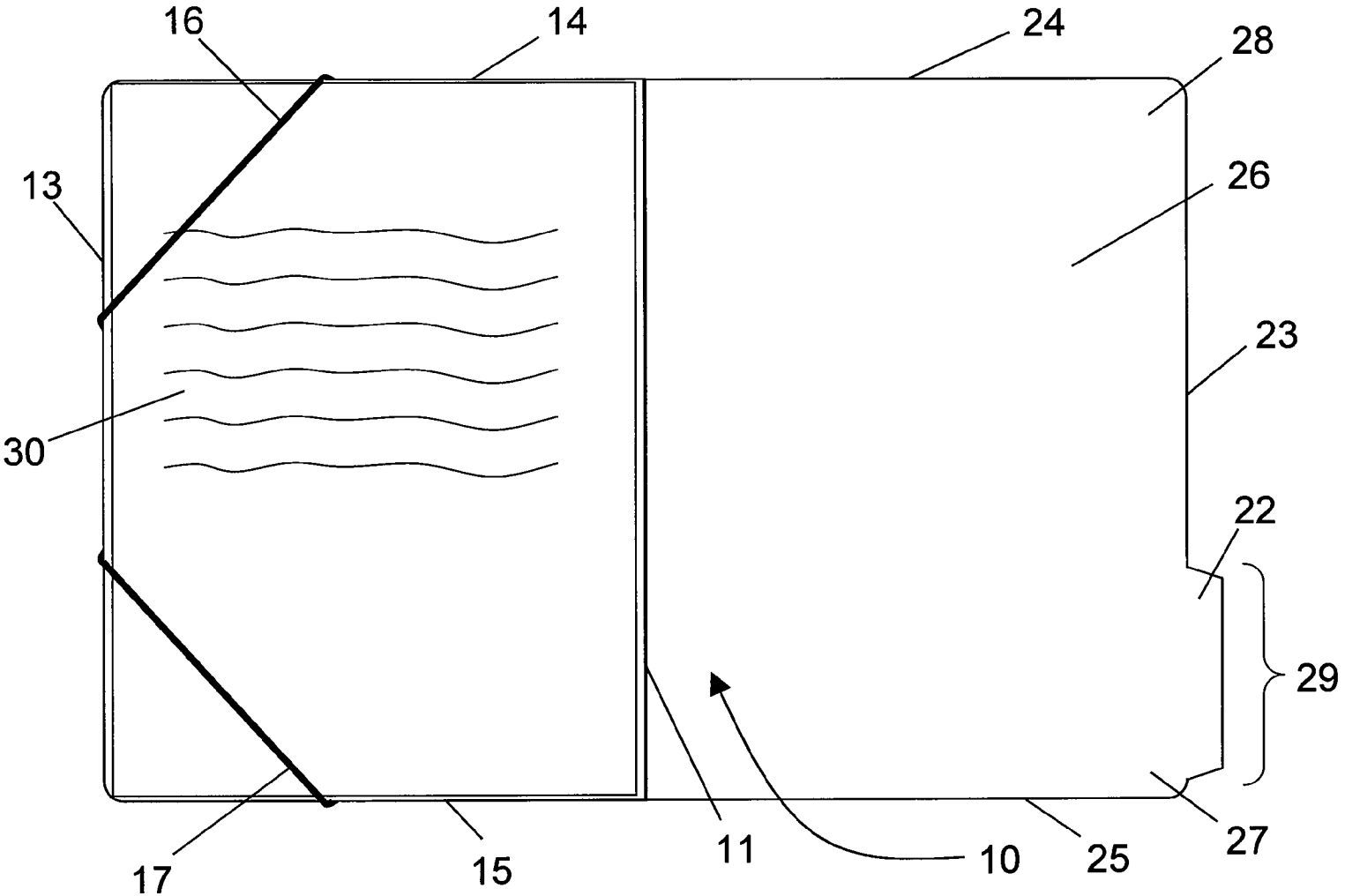
FIG. 4 is an interior view thereof with a stack of paper held therein.

FIG. 4 shows an exemplary embodiment of a file according to the present invention in an open position with a plurality of paper 30 being held therein. As can be seen in FIG. 4, a plurality of paper 30 can be retained by elastic retention elements 16,17 by placing the corners of the paper 30 underneath elastic retention elements 16,17 with respect to front cover panel 12. Accordingly, the plurality of papers 30 are retained by retention elements 16,17 on three sides when file 10 is in an open position; and along the fourth edge by hinge 11 when file 10 is closed. As one skilled in the art will ascertain, the plurality of paper 30 will also be retained in a vertical direction even when file 10 is open since the plurality of paper is held to the inside of front cover panel 12 by retention elements 16,17.

The placement of holes 20,21 may preferably be roughly positioned at or near the middle of edges 14,15, respectively so as to fully retain the plurality of papers 30 retained therein. However, it may be possible to retain the plurality of papers 30 when holes 20,21 are positioned in the middle (i.e. central) third portion of edges 14,15, respectively, for example. Depending on how closely the dimensions of the cover panels 12,26 match the dimensions of the plurality of papers to be retained therein, the position of holes 20,21 may be even closer to edge 23, for example.

The position of holes 35 and 37 can be considered when configuring file 10 since the location of holes 35,37 will directly affect (along with the position of holes 20,21) where along edges 13,23 elastic retaining elements 16,17 will naturally extend (wrap) around, for example. Accordingly, on skilled in the art should ascertain that various combinations of positions of holes 20,21,35,37 may be employed to provide for varying locations along edges 13,23 of where elastic retaining elements 16,17 will extend around. According to the exemplary embodiment illustrated in FIG. 4, retaining elements 16,17 extend around edges 13,23 at roughly ⅓ and ⅔ of the length of edges 13,23, respectively; such exemplary embodiment providing for three tab areas 29,31,33 with elastic retaining elements 16,17 extending around edges 13,23 therebetween, for example.

Figure 5:
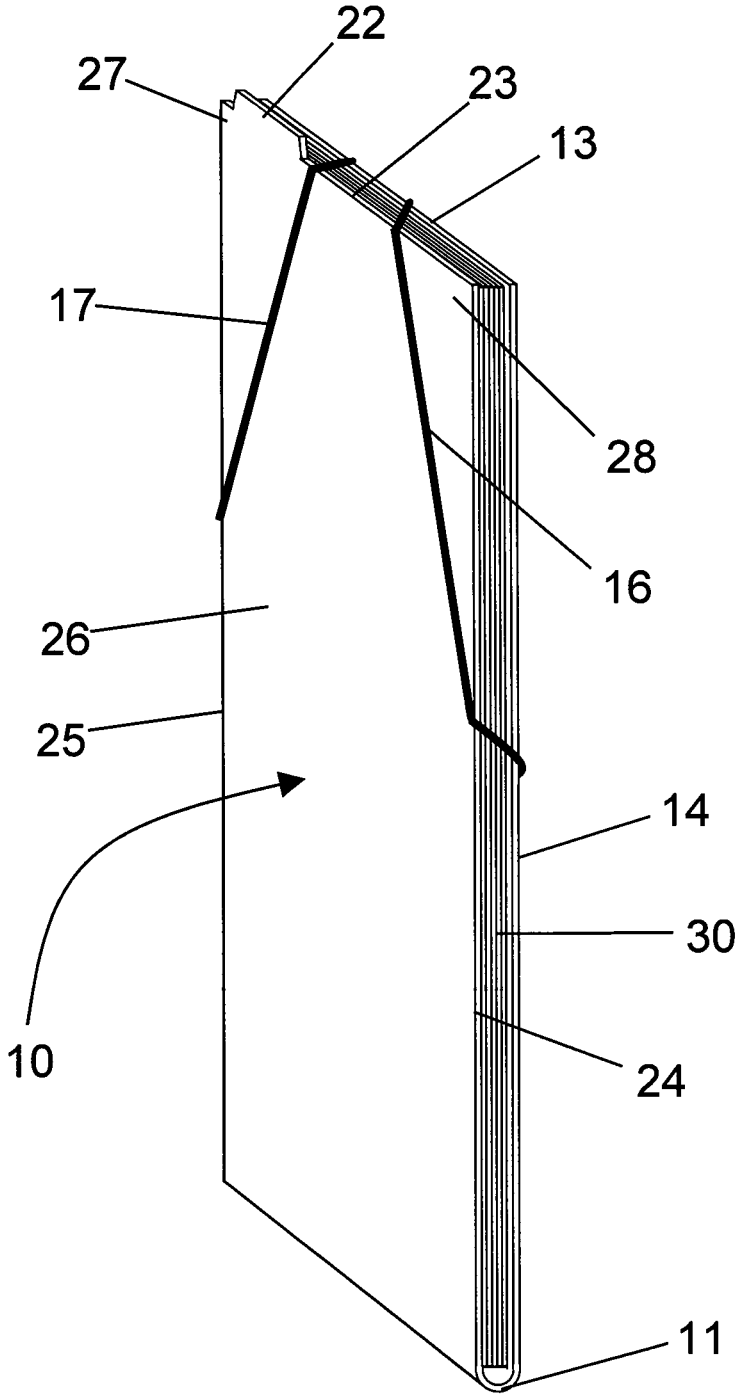
FIG. 5 is a perspective view of an exemplary embodiment of a file according to the present invention in a closed position with a stack of paper being held therein.

FIG. 5 shows a perspective view of an exemplary embodiment of a file according to the present invention in a closed position with a stack of paper being held therein. As can be seen in FIG. 5, a plurality of paper 30 is retained by elastic retention element 16 on the side of file 10 corresponding to edges 14,24, and retained by both elastic retention elements 16,17 on the top of file corresponding to edges 13,23. In addition, elastic retention element 17 retains the plurality of paper 30 on the far side (as illustrated) of file 10 corresponding to edge 25. FIG. 5 also shows how elastic retention elements traverse the sides of file 10 and loop around corners 27,28 in the exemplary embodiment illustrated therein.

As shown in FIG. 5, file 10 can be preferably dimensioned so as to roughly, and preferably closely, correspond with the dimensions of the plurality of paper 30 to be retained to minimize movement of the papers within the closed file to maintain an orderly stack. For example, covers panels 12,26 may each preferably be 8.75 inches high and 11.5 inches wide so as to be larger than the preselected paper size, for example by up to about 1 inch. But more preferably the file can be more closely sized in relation to the papers, preferably being larger in width and height by no more that about ½ inch or ¼ inch. Preferably, the covers are sized at least ⅛ inch larger than the preselected paper size in height an width. Alternate embodiments can use different sizes.

However, if the front cover panel 12 and/or back cover panel 26 are too much larger in their respective dimensions than the plurality of paper to be retained (e.g., if the covers extend over the plurality of papers by more than 1 inch), then there may be room for the plurality of paper to move within file 10 even when in a closed position, and thus not be as securely retained as when the front and back cover panels 12,26 were the roughly the same size or just a little larger than the plurality of papers 30 to be retained. Accordingly, the overall size and dimensions of the front and back cover panels 12,26 should be sized according to the size of the plurality of paper to be retained. However, one skilled in the art should appreciate that there are numerous sizes and shapes of paper for which there can be a need or desire to retain in a file according to an exemplary embodiment of the present invention; including a number of standard sizes and shapes, which number increases when considering international standards in addition to domestic standards. As such, exemplary embodiments according to the present invention are intended to cover such varying sizes and shapes.

Preferably, file 10 of a preferred embodiment may be configured to contain a plurality of sheets of office paper, such as letter, legal, A4 sized or greater, although most preferably the paper size is not substantially greater than legal size. Expandable file embodiments preferably are dimensioned to hold stacks of hundreds of preferably unfolded sheets. In addition, one skilled in the art should appreciate that although the preferred embodiment illustrated in FIG. 5 is of a bi-fold type of file without any additional flaps or pockets that would help retain the papers absent retaining elements 16,17, additional panels can be added and file 10 configured as, e.g., a tri-fold, quad-fold, etc. type of file.

Figure 6:
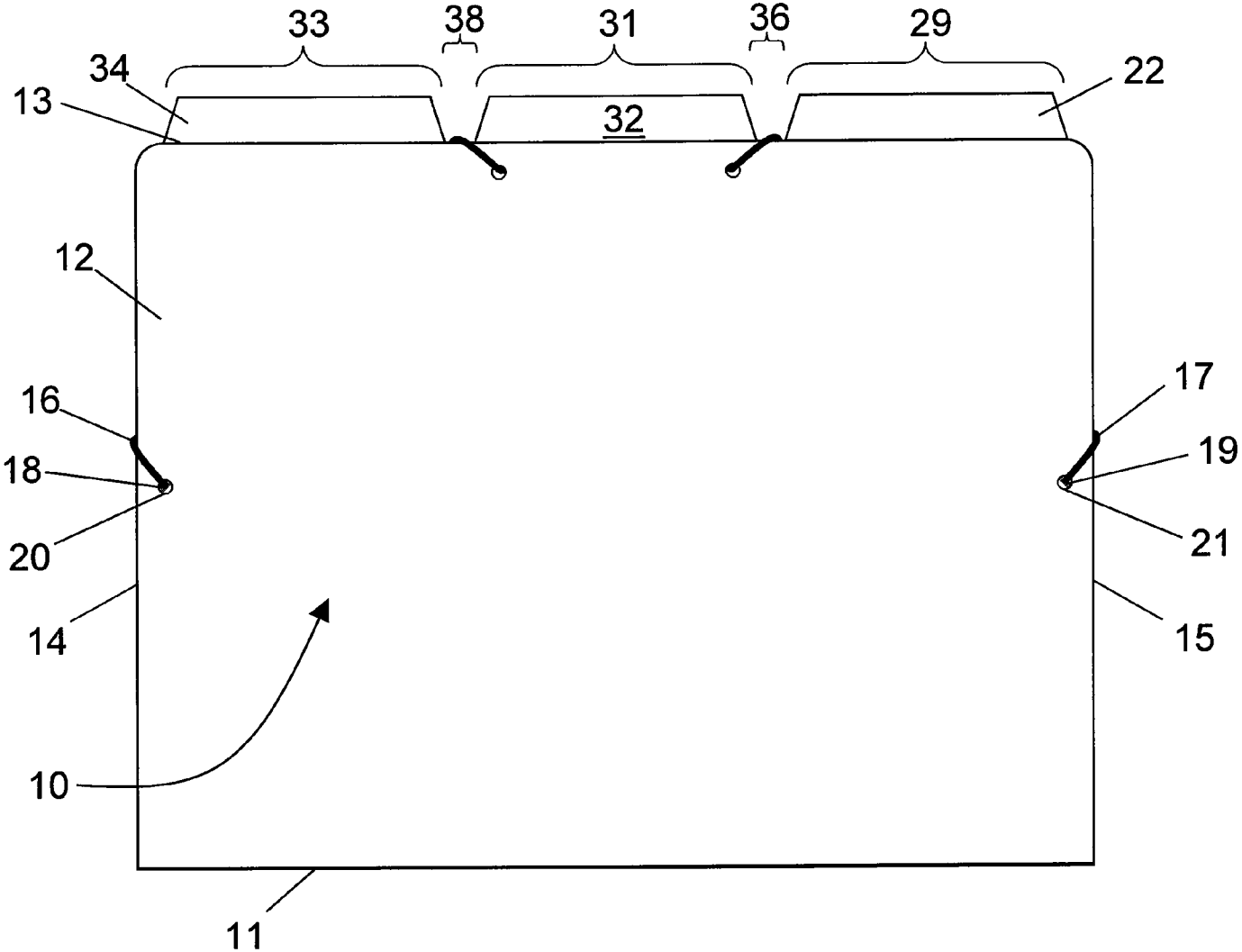
FIG. 6 is a front view of an exemplary embodiment of a group of files constructed according to the present invention.

FIG. 6 shows a front view of an exemplary embodiment of group of files constructed according to the present invention positioned one behind the other. As can be seen, three tab areas 29,31,33 are shown that each occupy a little less than ⅓ of the length of top edge 13. As mentioned above, each tab area 29,31,33 can have disposed therein one or more tabs 22,32,34, for example.

As can be seen in FIG. 6, between tab areas 29 and 31, and 31 and 33, are located pass spaces 36,38, through which retention elements 16,17 can pass without interfering with (or being interfered with) tabs 22,23,34 located in the tab areas, for example. This lack of interference between retention elements 16,17 and tabs 22,32,34 provide for less wear on both the retention elements and tabs, which generally provides for greater or prolonged use of a file according to an embodiment of the present invention. While it can be preferable for pass spaces 36,38 to be provided, another embodiment does not provide for these, with the tabs of the stacked files overlapping each other to a small extent, and with the elastic retention elements displaced in tension around the concave corners between the tabs and top edge. In yet another embodiment, some or all of the tabs can be disposed on the lateral edges 14,15,24,25 of the covers 12,26.

As an alternate to positioning tab areas 29,31,33, and tabs 22,32,34 so as to create pass spaces 36,38 that coincide with retention elements 16,17 as shown in FIG. 6, the holes (or mounts) located near top edge 13 can also be positioned to accommodate varying tab areas and tabs so as to have pass spaces 36,38 be located at various positions along top edge 13. As one skilled in the art will ascertain, numerous combinations can be employed according to various embodiments of the present invention.

All directional references (e.g. upper, lower, upward, downward, left, right, leftward, rightward, top, bottom above, below, vertical, horizontal, clockwise, and counterclockwise) are used for identification purposes to aid the reader's understanding of the present invention, and do not create limitations, particularly as to the position, orientation, or use of the invention. Various modifications and alterations to the described exemplary embodiments will be apparent to those skilled in the art in view of the teachings herein, and the features of the embodiments can be combined with each other. It will thus be appreciated that those skilled in the art will be able to devise numerous devices, arrangements and methods which, although not explicitly shown or described herein, embody the principles of the invention and are thus within the spirit and scope of the present invention. The detailed description, given by way of example, but not intended to limit the invention solely to the specific exemplary embodiments described, may best be understood in conjunction with the accompanying figures.

What is claimed is:

1. A file system comprising a group of files, each file of the group of files comprising:

a cover member comprising first and second cover panels that are hinged to each other at a living hinge for movement between open and closed positions, wherein the cover panels in the closed position define an interior space therebetween configured and dimensioned for containing a plurality of stacked papers, each cover panel having first and second corners disposed opposite from the hinge and defining a longitudinal edge length therebetween, the edge including first and second pass spaces disposed between the corners, wherein the first cover panel comprises a tab portion along the edge disposed between the corners outside the pass spaces and extending beyond the pass spaces of the cover panels in a direction away from the hinge; and first and second elastic retention elements, each having two ends that are mounted to the second cover panel in a position so that the elastic retention elements can reversibly be looped diagonally around the first and second corners of the cover panels, respectively, the retention elements crossing over the longitudinal edges at the pass spaces of both cover panels, in the closed position for retaining the closed position;

wherein the pass spaces of each of the files of the group are disposed in a common location such that the pass spaces of the files are aligned with each other when the files are arranged in a stack, aligned in a common orientation with each other; and wherein the tabs of various of the files are disposed in different locations along the edge of each of the various files so that the tabs of the various files remain unobstructed by each other in the stack.

2. The file system of claim 1, wherein the tab of each of the files is disposed between one of the retention elements and its adjacent corner with the retention elements looped around the corners.

3. The file system of claim 1, wherein the tab of at least one of the files is disposed between the retention elements with the retention elements looped around the corners.

4. The file system of claim 1, wherein the retention elements of each of the files are parts of a single elastic bungee.

5. The file system of claim 1, wherein each of the files is a file folder dimensioned for holding letter-size paper or larger.

6. The file system of claim 5, wherein each of the files is a file folder dimensioned for holding legal-size paper.

7. The file system of claim 1, wherein, in each of the files, the retention elements are secured to the cover panel at locations such that they naturally extend across from one cover panel to the other cover panel at the pass space out of contact with the tab.

8. The file system of claim 1, wherein, in each of the files, the retention elements are secured to the cover panel to cross from one panel to the other within about a central third of a height of the front and back panels measured from the hinge to an edge of each panel opposite from the hinge, such that the retention elements are positioned to retain contents of each folder laterally in the interior space when the retention elements are looped over the corners with the folder in the closed position.

9. The file system of claim 8, wherein, in each of the files, the retention elements are secured to the second cover panel to cross over the longitudinal edges within about a central third of the longitudinal edge to retain contents of each folder in the interior space when the retention elements are looped over the corners with the folder in the closed position.

10. The file system of claim 1, wherein each file is a file folder dimensioned for holding paper of letter or A4 size or larger.

11. The file system of claim 10, wherein the cover panels of each of the files are sized so as to completely cover the front and back of the plurality of papers in the closed position.

12. The file system of claim 1, wherein each of the files is configured for holding a stack of paper with a thickness of at least about ½ inch.

13. The file system of claim 1, wherein each of the files is a bi-fold file folder.

14. A file system comprising a group of files, each file of the group of files comprising:

a cover member comprising first and second cover panels that are hinged to each other at a hinge for movement between open and closed positions, wherein the cover panels in the closed position define an interior space therebetween configured and dimensioned for containing a plurality of stacked papers, each cover panel having first and second corners disposed opposite from the hinge and defining an longitudinal edge length therebetween, the edge including first and second pass spaces disposed between the corners, wherein the first cover panel comprises a tab portion along the edge outside the pass spaces and extending from the edge away from the hinge, the edge including a principal edge portion, the tab portion extending from the principal edge portion away from the hinge such that the principal edge portion is lower than the tab with respect to the hinge;

first and second elastic retention elements, each having two ends that are mounted to the second cover panel in a position so that the elastic retention elements can reversibly be looped diagonally around the first and second corners against the principal edge of the cover panels, respectively, the retention elements crossing over the principal edge at the pass spaces for retaining the closed position, wherein the first and second elastic retention elements in the diagonal orientation divide the edge into tab areas including:

a first corner area between the first corner and the first retention element, a middle area between the first and second retention elements, and a second corner area between the second retention element and the second edge;

wherein the tab is disposed wholly within one of the three areas to avoid interference with the elastic retention elements, the pass spaces of each of the files of the group are disposed in a common location such that the pass spaces of the files are aligned with each other when the files are arranged in a stack, aligned in a common orientation; and wherein the tabs of various of the files are disposed in different locations in the tab areas compared the other various files so that tabs of the various files remain unobstructed by each other in the stack.

15. The file system of claim 14, wherein the tab of a first of the files is disposed wholly within the first corner area, the tab of a second of the files is disposed wholly within the middle area, and the tab of a third of the files is disposed wholly within the second corner area.

16. The file system of claim 14, wherein each of the files is a tabbed file folder.

17. The file system of claim 16, wherein a tab of each of the files is of unitary construction with the cover panel.

18. The file system of claim 16, wherein the first and second elastic retention elements are the only retention elements connected to each of the files.

19. The file system of claim 14, wherein the hinge of each files is a living hinge.

20. The file system of claim 1, wherein in each of the files, the tab portion extends further from the living hinge than any portion of the other cover panel.

21. The file system of claim 1, wherein, in each of the files, the first and second retention elements are secured to one of the cover panels and the tab portion is disposed on the other cover panel.

22. The file system of claim 1, wherein the retention elements looped around the corners of each of the files in the closed position are out of contact with the tabs.

23. The file system of claim 14, wherein in each of the files, the principal edge portion is substantially straight.

24. The file system of claim 14, wherein in each of the files, the tab occupies less than ⅓ of the edge, and the principal edge portion comprises the remaining portion of the edge.

25. The file system of claim 14, wherein in each of the files, the retention elements are secured to the cover panel at locations such that they naturally extend across from one cover panel to the other cover panel at the principal edge portion out of contact with the tab portion.

26. The file system of claim 1, wherein:

the tab of a first of the files is disposed between one of the pass spaces and the first corner of the first of the files; and the tab of a second of the files is disposed between the pass spaces of the second of the files, such that the tabs of the first and second of the files are both visible and unobstructed by each other in the stack.

27. The file system of claim 1, wherein:

the tab of a first of the files is disposed between one of the pass spaces and the first corner of the first of the files; and the tab of a second of the files is disposed between another of the pass spaces and the second corner of the second of the files, such that the tabs of the first and second of the files are both visible and unobstructed by each other in the stack.

28. The file system of claim 27, wherein the tab of a third of the files is disposed between the pass spaces of the third of the files, such that the tabs of the first, second, and third of the files are each visible and unobstructed by each other in the stack.

* * * * *

UNITED STATES PATENT AND TRADEMARK OFFICE

CERTIFICATE OF CORRECTION

PATENT NO. : 9,073,379 B2
APPLICATION NO. : 12/538103
DATED : July 7, 2015
INVENTOR(S) : Grassia It is certified that error appears in the above-identified patent and that said Letters Patent is hereby corrected as shown below:

In the claims

Column 8, line 57 (Claim 1) remove --,-- after “panels”

Column 9, line 54 (Claim 14) replace --an-- between “defining” and “longitudinal” with --a--

Signed and Sealed this
Twenty-second Day of December, 2015

Michelle K. Lee

Michelle K. Lee
*Director of the United States Patent and Trademark Office*